US009366086B2

(12) United States Patent
Hewson et al.

(10) Patent No.: US 9,366,086 B2
(45) **Date of Patent: *Jun. 14, 2016**

(54) METHOD OF FORMING A BORE

(75) Inventors: James A. Hewson, Aberdeen (GB); Philip M. Burge, Aberdeenshire (GB)

(73) Assignee: Technology Ventures International Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/285,078

(22) Filed: Oct. 31, 2011

(65) Prior Publication Data

US 2012/0043135 A1 Feb. 23, 2012

Related U.S. Application Data

(60) Division of application No. 12/122,280, filed on May 16, 2008, which is a continuation-in-part of application No. 11/566,534, filed on Dec. 4, 2006, now abandoned, which is a continuation of application No. 10/785,456, filed on Feb. 24, 2004, now abandoned.

(51) Int. Cl.

| | |
|---|---|
| ***E21B 7/00*** | (2006.01) |
| ***E21B 10/26*** | (2006.01) |
| ***E21B 7/06*** | (2006.01) |
| ***E21B 7/20*** | (2006.01) |

(Continued)

(52) U.S. Cl.

CPC . *E21B 7/061* (2013.01); *E21B 7/20* (2013.01); *E21B 41/0035* (2013.01); *E21B 43/103* (2013.01)

(58) Field of Classification Search

CPC ..... E21B 7/061; E21B 7/06; E21B 29/002; E21B 29/005; E21B 29/007; E21B 29/06; E21B 7/20; E21B 43/103; E21B 33/14

USPC ..... 175/61, 73, 171, 257; 166/313, 117.5, 166/298, 55.1, 277, 207

See application file for complete search history.

(56) References Cited

U.S. PATENT DOCUMENTS

| | | | |
|---|---|---|---|
| 1,981,525 | A | 11/1934 | Price |
| 2,669,428 | A | 2/1954 | Zublin |

(Continued)

FOREIGN PATENT DOCUMENTS

| | | | |
|---|---|---|---|
| CA | 2517883 | A1 | 9/2004 |
| GB | 2347445 | A | 9/2000 |

(Continued)

OTHER PUBLICATIONS

Canadian Intellectual Property Office, Search Report, Oct. 18, 2013.

*Primary Examiner* — Nicole Coy
(74) *Attorney, Agent, or Firm* — Dinsmore & Shohl LLP

(57) ABSTRACT

A method of forming a supported subterranean well bore in which, in one disclosed embodiment, a first drill bit is mounted on a first string of casing tubulars via a steerable tool, and the drill bit is used to form a first bore. Upon reaching the required depth the casing string is cemented in place to support the formed bore and a second drill bit is mounted on a second casing string and is inserted into the first casing string. The second drill bit is used to drill through the wall of the first casing string and proceed to form a second, deeper bore. Once the second drill bit has reached the required depth, the second casing string is cemented in place to support the second bore.

8 Claims, 5 Drawing Sheets

(51) Int. Cl.
*E21B 41/00* (2006.01)
*E21B 43/10* (2006.01)

(56) References Cited

U.S. PATENT DOCUMENTS

| | | | | |
|---|---|---|---|---|
| 5,028,079 | A | 7/1991 | Smith et al. | |
| 5,035,292 | A | 7/1991 | Bailey et al. | |
| 5,462,120 | A | 10/1995 | Gondouin | |
| 5,884,698 | A | 3/1999 | Hughes et al. | |
| 5,887,668 | A | 3/1999 | Haugen et al. | |
| 5,957,225 | A | 9/1999 | Sinor | |
| 6,047,774 | A | 4/2000 | Allen | |
| 6,070,667 | A | 6/2000 | Gano | |
| 6,131,675 | A | 10/2000 | Anderson | |
| 6,371,203 | B2 | 4/2002 | Frank et al. | |
| 6,374,924 | B1 * | 4/2002 | Hanton et al. | 175/6 |
| 6,419,033 | B1 | 7/2002 | Hahn et al. | |
| RE37,867 | E | 10/2002 | Gondouin | |
| 6,543,552 | B1 | 4/2003 | Metcalfe et al. | |
| 6,564,870 | B1 * | 5/2003 | Grigsby et al. | 166/313 |
| 6,585,040 | B2 | 7/2003 | Hanton et al. | |
| 6,640,903 | B1 | 11/2003 | Cook et al. | |
| 6,648,068 | B2 | 11/2003 | Dewey et al. | |
| 6,708,769 | B2 | 3/2004 | Haugen et al. | |
| 6,749,026 | B2 * | 6/2004 | Smith et al. | 166/313 |
| 6,799,645 | B2 | 10/2004 | Mason et al. | |
| 6,892,819 | B2 | 5/2005 | Cook et al. | |
| 6,899,186 | B2 * | 5/2005 | Galloway et al. | 175/5 |
| 7,083,005 | B2 | 8/2006 | Galloway et al. | |
| 7,125,053 | B2 * | 10/2006 | Hashem | 285/333 |
| 7,159,673 | B2 | 1/2007 | Van Dijk | |
| 7,287,603 | B2 | 10/2007 | Hay et al. | |
| 2001/0002626 | A1 | 6/2001 | Frank et al. | |
| 2001/0047883 | A1 | 12/2001 | Hanton et al. | |
| 2002/0040787 | A1 | 4/2002 | Cook et al. | |
| 2002/0050360 | A1 * | 5/2002 | Cook et al. | 166/380 |
| 2004/0168808 | A1 * | 9/2004 | Smith | 166/313 |
| 2004/0244992 | A1 * | 12/2004 | Carter et al. | 166/380 |
| 2005/0045340 | A1 | 3/2005 | Hewson et al. | |
| 2005/0173121 | A1 * | 8/2005 | Steele et al. | 166/313 |
| 2005/0252688 | A1 | 11/2005 | Head et al. | |
| 2006/0185855 | A1 | 8/2006 | Jordan et al. | |
| 2007/0089910 | A1 | 4/2007 | Hewson et al. | |

FOREIGN PATENT DOCUMENTS

| | | | |
|---|---|---|---|
| GB | 2348223 | A | 9/2000 |
| GB | 2349401 | A | 11/2000 |
| GB | 2357101 | A | 6/2001 |
| GB | 2358619 | A | 8/2001 |
| GB | 2382361 | * | 5/2003 |
| GB | 2394235 | A | 4/2004 |
| WO | 0146550 | A1 | 6/2001 |

* cited by examiner

METHOD OF FORMING A BORE

CROSS-REFERENCE TO RELATED APPLICATIONS

This application is a divisional of U.S. patent application Ser. No. 12/122,280 filed May 16, 2008, which is a continuation-in-part of U.S. patent application Ser. No. 11/566,534 filed on Dec. 4, 2006, which is a continuation of U.S. patent application Ser. No. 10/785,456 filed on Feb. 24, 2004, which claims priority of GB 0320408.8 filed Sep. 1, 2003, all of which are incorporated herein by reference in their entirety.

BACKGROUND OF THE INVENTION

1. Field of the Invention

The present invention relates to a method of forming a supported bore, and in particular, but not exclusively, to a method of forming a subterranean well bore. The present invention also relates to an apparatus for forming a supported bore.

2. Description of the Related Art

In the oil and gas exploration and extraction industry, hydrocarbons contained within subterranean formations are accessed and flowed to surface via well bores drilled from surface to intersect the formations. Conventional methods of producing a well bore involve a staged process. Initially, a bore section is drilled using a drill bit mounted on a drill string comprising a combination of drilling pipes and collars, which are used to impart rotation and weight to the drill bit. After a certain depth, however, the walls of the bore are likely to become unstable and will eventually collapse if unsupported. Thus, to prevent collapse, the next stage involves pulling the drill bit and the drill string out of the hole to allow a supporting structure to be set in place. Often a bore will be drilled to a depth of between 610 to 915 m (2000 to 3000 ft) before support is provided. Thus, pulling the drill string out of the hole is extremely time consuming, considering that conventional drilling rigs and platforms can accommodate dismantling and storage of the drill string in lengths, known as "stands", of approximately 27.5 m (90 ft).

As noted above, once the drill bit and drill string have been removed from the hole a supporting structure is set in place. The supporting structure, generally referred to as the casing or liner, comprises a number of casing tubulars or liner tubulars which are normally coupled together by threaded connectors and extend to the bottom of the hole. Once the casing or liner is run into the bore, a cement slurry is pumped into the annulus formed between the wall of the bore and the casing, which cement cures to set and seal the casing in place.

Once the supporting structure is set in place, a slightly smaller diameter drill bit may then be run in the newly cased hole on the drill string, which has to be reassembled. Drilling may re-commence once the previous depth is achieved by the drill bit.

The above procedure is then repeated as necessary until the total required depth of the bore is accomplished, and as will be appreciated, the time taken to pull the drill bit and drill string out of the hole, and to run new casing or liner into the hole will increase after each drilling operation due to the increasing depth of the bore.

Furthermore, as the bore is progressively drilled in the manner described above, various readings must be taken in the bore before the casing is cemented in place, such as depth, temperature, pressure, formation characteristics and the lice. Acquiring such readings is generally termed "logging" or "open hole logging" and is normally carried out with the drill bit removed from the unsupported hole. Some logging operations, however, may be achieved with the drill bit located in the hole, and even while drilling, by utilizing Logging While Drilling (LWD) tools or Measurement While Drilling (MWD) tools, which can be elaborate and expensive.

SUMMARY OF THE INVENTION

It is among aspects of embodiments of the present invention to obviate, or at least mitigate one of the aforementioned problems. According to a first aspect of the present invention, there is provided a method of forming a supported bore comprising the steps of: mounting a first drill bit on a first tubular member; drilling a first bore to a first depth; inserting a second drill bit mounted on a second tubular member within the first tubular member; and directing the second drill bit towards a wall portion of the first tubular member and drilling through said wall portion and drilling a second bore to a second depth.

According to a second aspect of the present invention, there is provided a drilling assembly comprising a first drill bit mounted on a first tubular member and a second drill bit mounted on a second tubular member, wherein at least said first tubular member includes a deflecting member mounted therein.

Preferably, the first tubular member is cemented or otherwise fixed in the bore, before or after the second bore is drilled. Once the second bore is drilled to the required depth, the second tubular member may then be cemented or otherwise fixed in place within the second bore. Preferably, the second drill bit is directed towards the wall portion of the first tubular member by use of a deflecting member mounted within the first tubular member. Preferably also, the first drill bit is located on a steerable tool before being mounted on the first tubular member in order to provide the first drill bit and tubular member with directional drilling capability.

Thus, a supported bore may be provided by initially drilling a first bore using the first drill bit mounted on the first tubular member, wherein the first bore may be deviated as required by use of the steerable tool. Once the first bore has been drilled to the required depth, which depth may be dictated by the requirement to support the wall of the bore, a cement slurry or mixture is pumped into the annulus formed between the first tubular member and the bore wall to secure the first tubular member in the first bore. The drill bit and steerable tool may also be cemented in place and therefore become disposed in the bore.

To drill further, the second tubular member and drill bit are run into the first tubular member until the second drill bit reaches the level of the deflecting member, which forces or guides the second drill bit towards the wall of the first tubular member, through which an opening is drilled, allowing the second tubular member and drill bit to exit the first tubular member and proceed to drill a second bore. Thus, drilling through the wall of the first tubular member avoids the requirement to drill through the first drill bit, and steerable tool if present, to drill to the second depth.

Once the second bore is drilled as required, the second tubular member may then be cemented in place to support the bore wall. The process may then be repeated until the required total bore depth is achieved.

By cementing the drill bit supporting tubular members in place to case or line the bores, the time normally associated with providing a cased bore is greatly reduced as the requirement to pull the drill string and drill bit out of the hole and then run in a string of casing or a liner is eliminated.

Advantageously, the method according to the first aspect is particularly adapted for use in producing a supported bore which extends from surface level and intersects a subterranean hydrocarbon bearing formation.

Conveniently, the supported bore may be a deviated bore or a multilateral bore or the like.

The second drill bit may also be located on a steerable tool in order to provide the second drill bit and tubular member with directional drilling capability. Preferably, the steerable tool is a mechanical device that can be adjusted to effect changes in bore direction. The steerable tool may take any appropriate form and may be, for example, a directional drilling apparatus such as that described in Applicant's UK Patent Application no. 0212553, the disclosure of which is incorporated herein by reference.

As noted above, the deflecting member, in use, directs the second drill bit towards the wall portion of the first tubular member, through which a hole is drilled to allow a second bore to be drilled. The deflecting member is preferably set at a chosen angle with respect to the longitudinal axis of the first tubular member. Preferably also, the deflecting member is fixed relative to the first tubular member. The deflecting member may be set at an angle of between 0.5 to 5 degrees with respect to the longitudinal axis of the first tubular member, resulting, in use, in the second drill bit being deflected from its initial path by a corresponding angle.

Preferably, the deflecting member includes a hardened surface to deflect the second drill bit towards the wall of the first tubular member, and to prevent the member from being destroyed by the drill bit. Preferably also, the deflecting member defines at least one fluid communicating aperture which allows the flow of fluids through and past the deflecting member. Such fluids may be drilling fluid or cement slurry or the like. Conveniently, the deflecting member may be a whipstock or a kick-off plate or the like.

Advantageously, the portion of the wall of the first tubular member opposing the deflecting member is of a reduced hardness relative to the remaining portion of the first tubular member. This allows the second drill bit to more readily drill through the wall of the first tubular member. The portion of the wall to be drilled may, for example, be composed of a relatively soft metallic material or a composite material or the like.

Preferably, the first tubular member is a tubing string or a drill string comprising at least one, and preferably a plurality of casing tubulars. Alternatively, the tubing or drill string may comprise at least one liner tubular.

Conveniently, the second tubular member is a tubing string or a drill string and preferably comprises a plurality of casing tubulars and/or liner tubulars or the like. Alternatively, the second tubular member may comprise a plurality of drilling tubulars or drilling collars, or a combination thereof.

Advantageously, rotation of the drill bit to effect drilling is provided by corresponding rotation of the tubular member upon which it is mounted. Alternatively, rotation of the drill bit may be achieved by use of a downhole drive unit, such as a positive displacement mud motor, for example.

Advantageously, at least the first tubular member includes a valve assembly for preventing fluids such as cement which are located in the annulus from flowing or being displaced into the tubular member. The valve assembly may be a collar having a selectively closable fluid communicating throughbore. Preferably, the valve assembly is a float collar and is located above the deflecting member.

Preferably, the second tubular member also includes a valve assembly, such as a float collar or the like. Conveniently, the valve assembly defines a throughbore allowing fluids such as cement or drilling fluid which is pumped through the tubular members to pass therethrough. Preferably, the through bore of the valve assembly may be selectively closed, by, for example, a plug or dart provided from surface level. Alternatively, the throughbore may be closed by a flapper valve or a ball valve or the like.

Preferably, the first tubular member includes means for determining at least one parameter of the bore. Preferably also, the second tubular member includes a deflecting member and means for determining at least one parameter of the bore.

Conveniently, the means for determining at least one parameter of the bore may include a data acquisition apparatus such as a bore logging apparatus. Advantageously, the data acquisition apparatus may perform data acquisition while the bore is being drilled. Conveniently, a landing joint may be provided on a portion of the corresponding tubular member in order to provide a means for locating the data acquisition apparatus within the corresponding tubular member and also for allowing the acquisition apparatus to be retrieved from within the tubular member.

In a preferred embodiment of the present invention, the logging tool landing joint is located above the deflecting member and is located in a fixed position relative thereto such that the orientation of the deflecting member, and thus the deflection angle, may be ascertained by, for example, the data acquisition apparatus. Thus, the direction in which the second bore will initially be drilled by the second drill bit can readily be determined by knowing the orientation of the deflecting member.

Preferably, any data acquisition apparatus located within a corresponding tubular member is retrieved before the tubular member is cemented in place within the bore.

Thus, by providing a data acquisition apparatus of the type described above which may acquire data while the bore is being drilled, the requirement to pull the drill bit and corresponding tubular member out of the hole to perform such data acquisition in a separate operation is eliminated.

Conveniently, the first tubular member further includes means for determining the orientation of the first drill bit. This may be achieved by use of the data acquisition apparatus, for example. Alternatively, the orientation of the first drill bit may be achieved by use of a Measurement While Drilling (MWD) apparatus. Alternatively further, the steerable tool upon which the first drill bit is located may include means for directly or indirectly determining the orientation of the first drill bit.

Preferably, means are provided for determining the orientation of the second drill bit, which means may be included in the second tubular member and may comprise MWD apparatus or Logging While Drilling (LWTD) apparatus or the like. Alternatively, where the second drill bit is located on a steerable tool, the orientation of the second drill bit may be directly or indirectly determined by said steerable tool.

According to a third aspect of the present invention, there is provided a method of forming a supported bore comprising the steps of: locating a first drill bit on a steerable tool and mounting the steerable tool and first drill bit on a first tubular member, said first tubular member including a deflecting member and means for determining at least one parameter of the bore and the orientation of the drill bit; drilling a first bore to a first depth; inserting a second drill bit mounted on a second tubular member within the first tubular member; and drilling through a wall portion of the first tubular member at the location of the deflecting member and drilling a second bore to a second depth.

According to a fourth aspect of the present invention, there is provided a method of forming a supported bore, said method comprising the steps of locating a first drill bit on a first expandable tubular member having an upper portion of a first diameter and a lower portion of a second, larger diameter; drilling a bore with the drill bit mounted on the first expandable tubular member; pumping cement into an annulus formed between the expandable tubular member and the wall of the bore; and expanding the upper portion of the tubular member to a third diameter, greater than the first diameter.

Preferably, the third diameter is substantially equal to the second diameter.

According to a fifth aspect of the present invention, there is provided a drilling assembly comprising a first drill bit mounted on a first expandable tubular member, wherein said first expandable tubular member includes an upper portion of a first diameter and a lower portion of a second, larger diameter.

Advantageously, the volume of cement pumped into the annulus between the tubular member and the bore wall is selected such that the annulus is substantially filled with cement when the upper portion of the expandable tubular member has been expanded.

Preferably, the upper portion of the tubular member is expanded by use of an expansion mandrel forced through the tubular member. Preferably, the mandrel is moved in an upwards direction to expand the tubular member. Alternatively, the mandrel is moved in a downwards direction through the tubular member.

Conveniently, the mandrel is substantially conical or frusto-conical. It should be noted, however, that any other shape of mandrel as would readily be selected by a person of skill in the art may be used.

Preferably, the tubular member includes a valve member defining a throughbore through which fluid may pass. Additionally, the mandrel may define a fluid transmitting throughbore providing a passage for fluid. Thus, fluid such as drilling fluid or cement may be pumped into the tubular member, pass through the throughbores in the mandrel and the valve member respectively, and proceed to flow into the annulus between the bore wall and the tubular member.

Conveniently, the valve member is a collar such as a float collar and assists in preventing fluid contained within the annulus from flowing or being displaced into the tubular member. Preferably, the mandrel is initially located within the lower portion of the tubular member above the valve member.

Once the required volume of cement is located within the annulus, the throughbore in the valve member may be closed by a plug or dart provided from surface, or alternatively by a flapper valve or a ball valve or the like. Thus a chamber may be formed between the collar and the mandrel.

Preferably, the method further comprises the step of pressurizing the chamber formed between the mandrel and the valve member, or otherwise creating a pressure differential across the mandrel, such that the mandrel is forced upwards or downwards as required through the tubular member to effect expansion due to a pressure differential between the fluid above and below the mandrel.

Preferably, by initially pressurizing the chamber, the throughbore in the mandrel is closed to maximize the above noted pressure differential. The mandrel throughbore may be closed by use of a one way pressure valve, for example, such as a flapper valve or the like.

The chamber may be pressurized with a fluid provided from surface, which fluid may be pumped through the mandrel and into the chamber. Preferably, the mandrel comprises a pumping mechanism to pump fluid into the chamber. Alternatively, a separate pumping unit may be utilized to pump fluid into the chamber, which separate pumping unit may be located adjacent the mandrel or alternatively at surface level.

Alternatively, or additionally, the mandrel may be forced through the tubular member by pulling from the surface. For example, once the appropriate drill bit has reached the required depth, a support member, such as a string of drill pipe or a reelable support, may be fed down hole and coupled to the mandrel, which support may be used to pull the mandrel upwards, to effect, or assist in expanding the tubular member in which it is located. Alternatively, or in addition, the support may be utilized to supply pressurized fluid to create a pressure differential across the mandrel, or in other embodiments may be utilized to push the mandrel downwards to expand the tubular mandrel.

Advantageously, once the tubular member has been expanded as required, the mandrel may be removed therefrom.

Preferably, the method further comprises the step of inserting a second drill bit mounted on a second tubular member within the first tubular member after said first tubular member has been expanded and drilling through a wall portion of the first tubular member and subsequently drilling a second bore.

Once the second bore is drilled to the required depth, cement may be pumped into an annulus formed between the wall of the second bore and the second tubular member.

Advantageously, the first expandable tubular member includes a deflecting member, which deflecting member, in use, deflects or guides the second drill bit towards a wall portion of the first tubular member to be drilled. Preferably, the deflection member is located below the valve member and the mandrel.

Preferably, the deflecting member is set at a chosen angle with respect to the longitudinal axis of the first tubular member. Preferably also, the deflecting member is fixed relative to the first tubular member. The drilling member may be set at an angle of between 0.5 to 5 degrees with respect to the longitudinal axis of the first tubular member, resulting in the second drill bit being deflected by a corresponding angle.

Advantageously, the portion of the wall of the first tubular member opposing the deflecting member is of a reduced hardness relative to the remaining portion of the first tubular member. This allows the second drill bit to more readily drill through the wall of the first tubular member. The portion of the wall to be drilled may, for example, be composed of a relatively soft metal material or a composite material or the like.

Preferably, the deflecting member includes a hardened surface to deflect the second drill bit towards the wall of the first tubular member, and to prevent the member from being destroyed by the drill bit. Preferably also, the deflecting member defines at least one fluid communicating aperture which allows the flow of fluids through and past the deflecting member. Such fluids may be drilling fluid or a cement slurry or the like.

Conveniently, the deflecting member may be a whipstock or a kick-off plate or the like.

In one embodiment of the present invention, the second tubular member may be expandable and a portion thereof may be expanded to a larger diameter once the second bore has been drilled to the required depth. The second tubular member may be expanded before cement is pumped into the annulus between the second bore wall and the second tubular member, or may preferably be expanded after cement is pumped into the annulus.

Preferably, the first tubular member is a tubing string or a drill string comprising at least one, and preferably a plurality of casing tubulars. Alternatively, the tubing or drill string may comprise at least one liner tubular.

Conveniently, the second tubular member is a tubing string or a drill string and preferably comprises a plurality of casing tubulars and/or liner tubulars or the like. Alternatively, the second tubular member may comprise a plurality of drilling tubulars or drilling collars, or a combination thereof.

Preferably, the first drill bit is located on a steerable tool such that the first drill bit and the first tubular member are provided with directional drilling capability. Similarly, the second drill bit may be located on a steerable tool.

In a preferred embodiment, the first tubular member includes means for determining at least one parameter of the bore. Conveniently, the means for determining at least one parameter of the bore may include a data acquisition apparatus such as bore logging apparatus. Advantageously, the data acquisition apparatus may perform data acquisition while the bore is being drilled. Conveniently, a landing joint may be provided on a portion of the corresponding tubular member in order to provide a means for locating the data acquisition apparatus within the corresponding tubular member and also for allowing the acquisition apparatus to be retrieved from within the tubular member.

In a preferred embodiment of the present invention, the logging tool landing joint is located above the deflecting member and is located in a fixed position relative thereto such that the orientation of the deflecting member, and thus the deflection angle, may be ascertained by, for example, the data acquisition apparatus. Thus, the direction in which the second bore will be drilled by the second drill bit can readily be determined.

Preferably, any data acquisition apparatus located within a corresponding tubular member is retrieved before the tubular member is cemented in place within the bore.

Conveniently, the first tubular member further includes means for determining the orientation of the first drill bit. This may be achieved by use of the data acquisition apparatus, for example. Alternatively, the orientation of the first drill bit may be achieved by use of a Measurement while Drilling (MWD) apparatus. Alternatively further, the steerable tool upon which the first drill bit is located may include means for directly or indirectly determining the orientation of the first drill bit.

Preferably, means are provided for determining the orientation of the second drill bit, which means may be included in the second tubular member and may comprise MWD apparatus or Logging While Drilling (LAD) apparatus or the like. Alternatively, where the second drill bit is located on a steerable tool, the orientation of the second drill bit may be directly or indirectly determined by said steerable tool.

Advantageously, rotation of the drill bit to effect drilling is provided by corresponding rotation of the tubular member upon which it is mounted. Alternatively, rotation of the drill bit may be achieved by use of a downhole drive unit, such as a positive displacement mud motor, for example.

According to a sixth aspect of the present invention, there is provided a method of forming a supported bore comprising the steps of: locating a first drill bit on a steerable tool and mounting the steerable tool and first drill bit on a first expandable tubular member, said first expandable tubular member including a deflecting member and means for determining at least one parameter of the bore and the orientation of the drill bit; drilling a first bore to a first depth; pumping cement into an annulus formed between the first tubular member and the wall of the first bore; expanding a portion of the first expandable tubular member to a larger diameter; inserting a second drill bit mounted on a second tubular member within the first tubular member; drilling through a wall portion of the first tubular member at the location of the deflecting member and drilling a second bore to a second depth; and cementing the second tubular member in place within the second bore.

BRIEF DESCRIPTION OF THE DRAWINGS

These and other aspects of the present invention will now be described, by way of example only, with reference to the accompanying drawings, in which.

DETAILED DESCRIPTION OF THE PREFERRED EMBODIMENT

Figure 1:
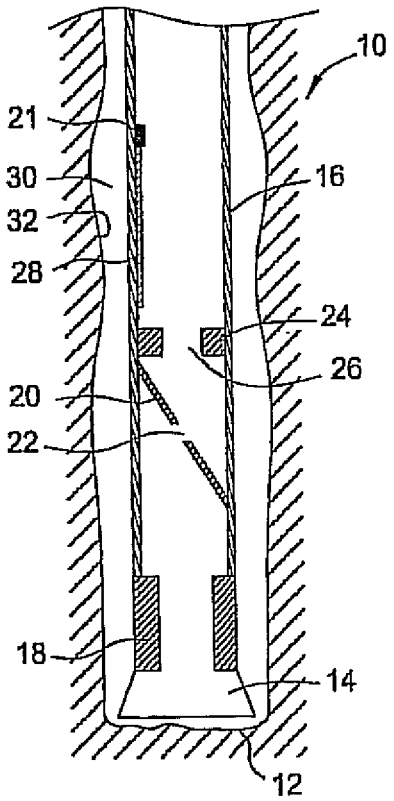
FIGS. 1 to 3 are diagrammatic cross-sectional views of a drilling assembly for use in forming a supported bore in accordance with an embodiment of an aspect of the present invention.

Reference is first made to FIG. 1 in which there is shown a cross-sectional view of a drilling assembly 10 for use in forming a well bore 12 in accordance with one embodiment of an aspect of the present invention. The drilling assembly 10 includes a drill bit 14 mounted on a tubular member 16 via a steerable tool 18. In the embodiment shown the tubular member 16 is a string of casing tubulars commonly used in subterranean well bores, which casing string extends from surface and provides rotation and weight to the drill bit 14. The steerable tool 18 is a mechanical device that can be adjusted to effect changes in bore direction; that is, the steerable tool 18 provides the drilling apparatus 10 with directional drilling capability.

The drilling apparatus farther includes a deflecting member 20 which defines a fluid communicating aperture 22 which allows the flow of fluids therethrough. Additionally, a float collar 24 is also provided, located above the deflecting member 20, which float collar also defines a fluid communicating aperture 26. The apertures 22 and 26 allow the passage of fluids such as a drilling mud or a cement slurry or the like. Furthermore, the drilling assembly 10 further includes a logging tool landing joint 28 located above the float collar 24 and the deflecting member 20. The function of the deflecting member 20, float collar 24 and landing joint 28 will become apparent from the subsequent description.

In use, the drilling assembly 10 drills a first bore 12 to a first depth, wherein the steerable tool 18 is used to control the direction of the bore 12. While drilling, a data acquisition apparatus 21 or logging apparatus is positioned in the tubular member in the region of the logging tool landing joint 28, which landing joint 28 provides a means for locating the data acquisition apparatus within the tubular member 16, and also for allowing the acquisition apparatus to be retrieved from within the tubular member 16. The data acquisition apparatus may be used to record data such as bore depth, temperature, pressure and formation characteristics and the like.

Figure 2:
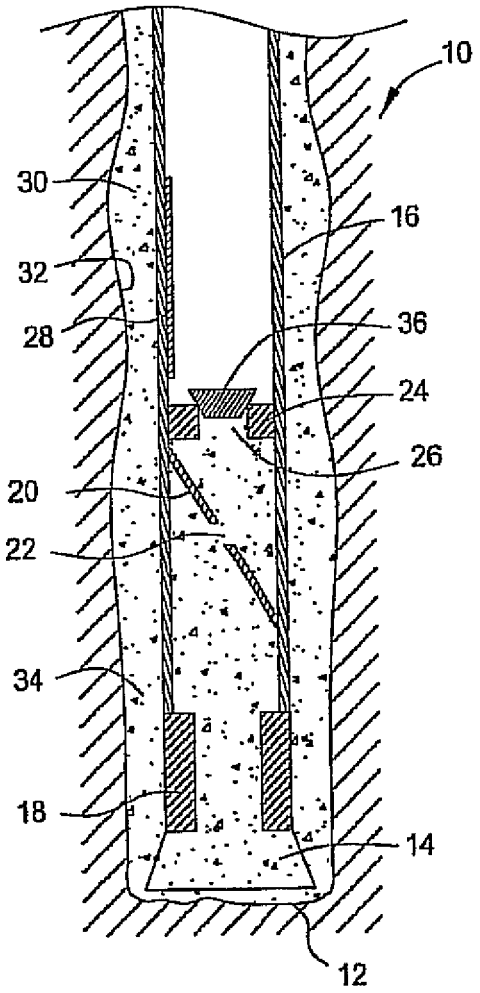

Once the first depth is achieved, the data acquisition apparatus is retrieved from the tubular member 16 and cement 34 is pumped through the tubular member, through apertures 22, 26, and into the annulus 30 formed between the bore wall 32 and the tubular member 16, as shown in FIG. 2. Once the required volume of cement 34 has been pumped into the annulus 30, a dart 36 is provided from surface level which closes the aperture 26. Thus, the float collar 24 prevents cement from being displaced back into the tubular member 16. As shown in FIG. 2, the drill bit 14 and steerable tool 18 also become cemented in place and therefore remain disposed in the bore 12. By cementing the tubular member 16 in place a supported bore may be provided without the requirement of pulling the drill bit and associated drilling string out of the hole and then running in and cementing in place a separate casing or liner string to support and seal the bore.

Figure 3:
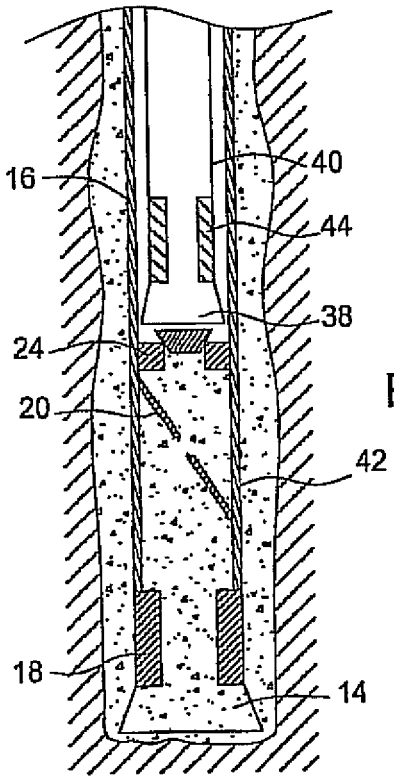

To drill further, a second, slightly smaller diameter drill bit 38 mounted on a second tubular member 40 is run into the tubular member 16, as shown in FIG. 3 of the drawings. The second drill bit 38 is rotated by the second tubular member 40 from surface. The second drill bit 38 initially drills through the float collar 34 and underlying cement until reaching the level of the deflecting member 20 which directs the second drill bit towards a wall portion 42 of tubular member 16, through which wall portion 42 a hole is drilled to allow the second drill bit 38 and tubular member 40 to proceed to drill a second bore to a second depth.

The deflecting member 20 is set at a chosen angle with respect to the longitudinal axis of tubular member 16. It should be noted that the angle of inclination of the deflecting member 20 is exaggerated in the drawings for illustrative purposes and that the member 20 is likely to be set at an angle of between 0.5 and 5 degrees. The deflecting member 20 includes a hardened surface to deflect the second drill bit 38 towards wall portion 42 and to prevent the member 20 from being destroyed by the drill bit 38.

The deflecting member 20 is located in a fixed position relative to the logging tool landing joint 28 (FIG. 1) such that the orientation of the deflecting member 20, and thus the deflection angle, may be ascertained by the data acquisition apparatus when in place. Thus, the direction in which the second bore will initially be drilled can readily be determined by knowing the orientation of the deflecting member 20.

In the embodiment shown, the wall portion 42 to be drilled by the drill bit 38 is of a reduced hardness relative to the remaining portion of tubular member 16 to allow the drill bit 38 to more readily drill through the wall of the tubular member 16. The wall portion 42 may be composed of a relatively soft metallic material or a composite material or the lice.

Once the second bore has been drilled to a second depth, the second drill bit 38 and tubular member 40 are cemented in place in a similar fashion to that described with reference to FIG. 2 in order to support and seal the second bore. Additionally, the second tubular member 40 may also include a deflecting member such that a further bore may be drilled from within the second tubular member 40.

As shown in FIG. 3, the second drill bit 38 is mounted on the second tubular member 40 via a steerable tool 44 to provide the second drill bit 38 with directional drilling capability.

Figure 4:
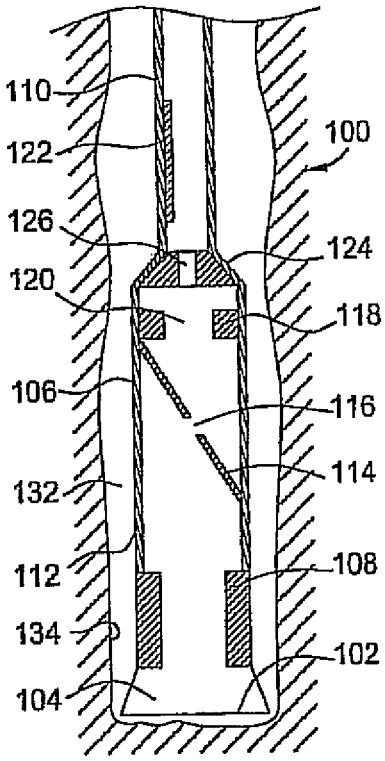
FIGS. 4 to 7 are diagrammatic cross-sectional views of a drilling assembly for use is forming a supported bore in accordance with an embodiment of an alternative aspect of the present invention.

Reference is now made to FIG. 4 in which there is shown a diagrammatic cross-sectional view of a drilling assembly 100 for use in forming a well bore 102 in accordance with an embodiment of another aspect of the present invention. The drilling assembly 100 comprises a drill bit 104 mounted on an expandable tubular member 106 via a steerable tool 108. The steerable tool 108 is a mechanical device that can be adjusted to effect changes in bore direction; that is, the steerable tool 108 provides the drilling apparatus 100 with directional drilling capability.

The tubular member 106 is a string of casing tubulars and includes an upper portion 110 of a first diameter and a lower portion 112 of a second larger diameter.

The drilling apparatus 100 further includes a deflecting member 114 located within the lower portion 112, which deflecting member 114 defines a fluid communicating aperture 116 which allows the flow of fluids therethrough. Additionally, a float collar 118 is also provided within the lower portion, above the deflecting member 114, which float collar also defines a fluid communicating aperture 120. Furthermore, the drilling assembly 100 includes a logging tool landing joint 122 located in the upper portion 110 of the tubular member 106 above the float collar 118 and the deflecting member 114. The function of the deflecting member 114, float collar 118 and landing joint 122 are similar to those described with reference to the embodiment shown in FIGS. 1 to 3, as will become apparent from the subsequent description.

The drilling assembly 100 also includes an expansion mandrel 124 located in a transition region between the upper and lower portions 110, 112. As shown in FIG. 4, the expansion mandrel 124 defines a fluid communicating throughbore 126 allowing for the passage of fluids such as drilling mud or cement or the like.

In use, the drilling assembly 100 is utilized to drill a bore 102 to the required depth and at the required orientation by employment of the steerable tool 108. While drilling, a data acquisition apparatus (not shown) is located in the upper portion 110 of the tubular member 106 at the location of the logging tool landing joint 122 to record well bore data such as temperature and pressure and the like. Additionally, the data acquisition apparatus may assist in determining the orientation of the drill bit 104.

Figure 5:
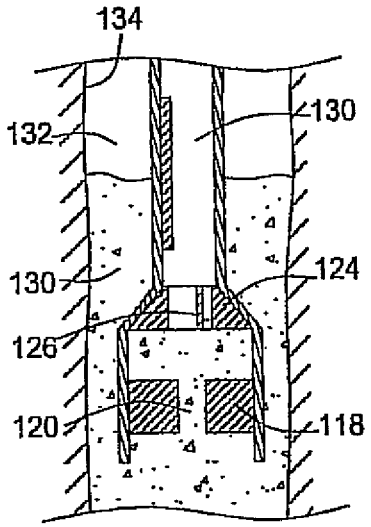
Figure 6:
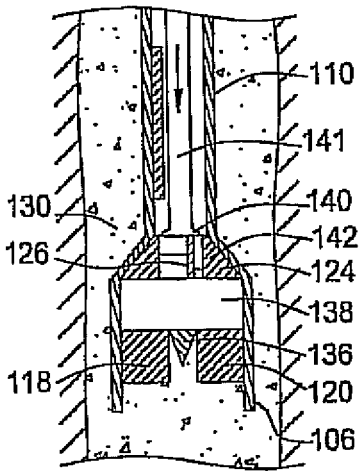

Once the required depth of the bore is achieved, the data acquisition apparatus is retrieved from the tubular member 106 and a cement slurry 130 is pumped into the tubular member 106, through apertures 116, 120 and throughbore 126, and into an annulus 132 formed between the bore wall 134 and the tubular member 106, as shown in FIG. 5. Once the required volume of cement 130 has been pumped into the annulus 132, a dart 136 is provided from surface level which passes through the throughbore 126 in the expansion mandrel 124 and closes the aperture 120 in the float collar 118, shown in FIG. 6. Thus, the float collar 118 prevents cement 130 from being displaced back into the tubular member 106. As described above with reference to FIG. 2, the drill bit 104 and steerable tool 108 also become cemented in place and therefore remain disposed in the bore 102.

Figure 7:
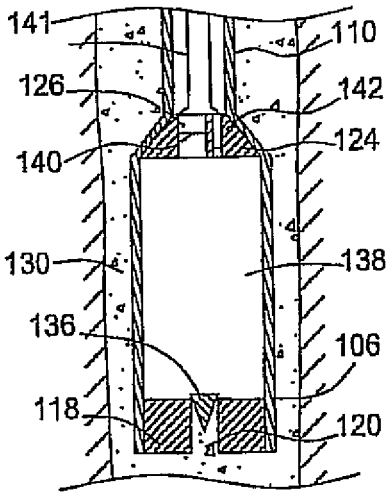

By closing aperture 120 in the float collar 118, a chamber 138 is formed between the collar 118 and the mandrel 124. Once the dart 136 is in place, a fluid is pumped into the chamber 138 through the mandrel 124 to pressurize the chamber 138 in order to force the mandrel 124 upwards through the tubular member 106 to expand the upper portion 110, as shown in FIG. 7, before the cement 130 has cured. By initially pressurizing the chamber 138 a flapper valve 140 closes the throughbore 126 in the mandrel to maximize the pressure differential between the fluid above and below the mandrel 124.

The chamber 138 is pressurized by fluid provided through a tubular member 141 which is run in from surface to engage a suitable profile on the mandrel 124, which fluid is pumped through a further throughbore 142 in the mandrel 124. The tubular member 141 may take any appropriate form, and may be a string of drill pipe, a reelable support, such as coil tubing, or a control line. When a heavier tubular member 141 is utilized, such as a drill pipe string, the member 141 may be utilized to pull the mandrel 124 upwardly through the tubular member 106 to assist in expansion of the upper portion 110.

Once the upper portion 110 is fully expanded, the mandrel 124 is removed from the tubular member 106 and a structure similar to that shown in FIG. 2 is produced. Further drilling may then be achieved in a similar manner to that described with reference to FIG. 3, wherein the deflecting member 114 deflects a further drill bit towards the wall of the tabular member 106 to drill through said wall and proceed to drill a further bore.

It should be obvious to a person of skill in the art that the above described embodiments are merely exemplary of aspects of the invention and that various modifications may be made thereto without departing from the scope of the present invention. For example, the drill bit may be directly mounted to the corresponding tubular member and the drill bit may be rotated by downhole drive means such as a positive displacement mud motor or the like. Additionally, the second tubular member 40 shown in FIG. 3 may be a recoverable drill string.

The embodiment shown in FIGS. 1 to 3 may be used in combination with that shown in FIGS. 4 to 7, wherein a first supported bore is provided using the drilling assembly 10 (FIG. 1), and the drilling assembly 100 (FIG. 4) is run into the first supported bore to form a second supported bore, wherein the diameter of the second supported bore is maximized by expansion of tubular member 106.

The tubular member 106 (FIG. 4) may be expanded before cement is pumped into the annulus.

In another embodiment, the tubular member 141 may be adapted to cooperate with the aperture 126 and be utilized to deliver the cement 130 and the dart 136 from surface. In this case the flapper valve 140 and the additional throughbore 142 may be omitted.

Figure 8:
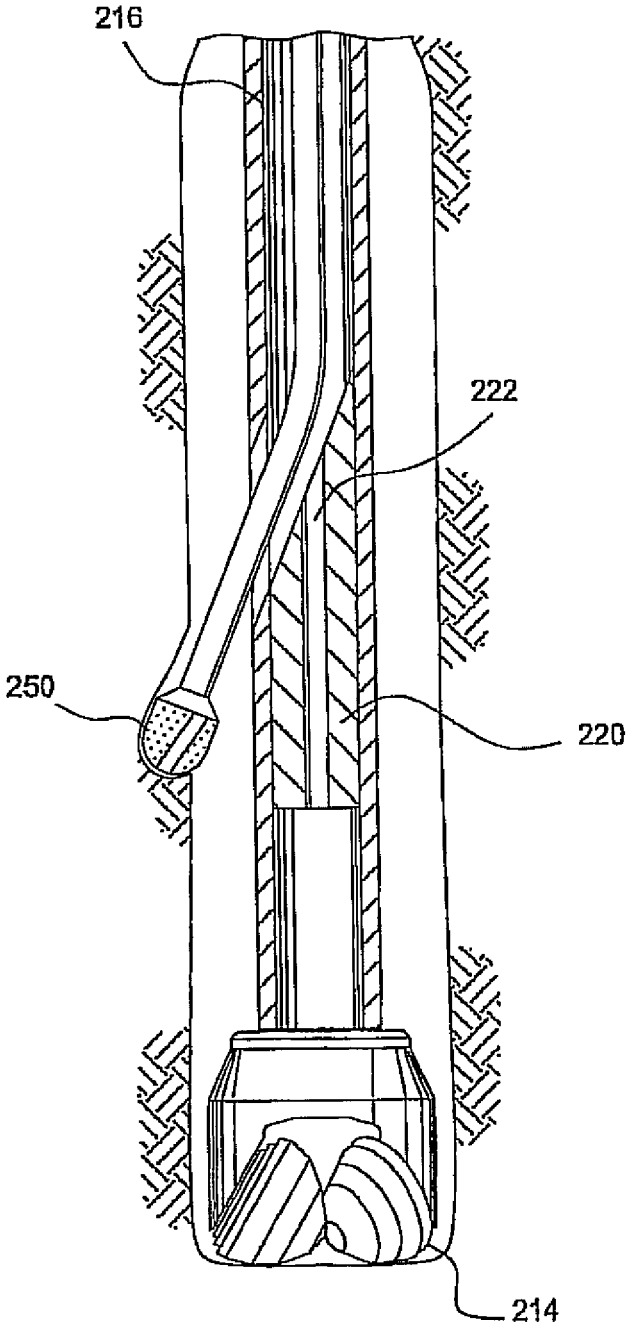
FIG. 8 is a cross-sectional view illustrating a lateral bore drilling operation using a hollow diverter in the casing assembly in accordance with an embodiment of an alternative aspect of the present invention.

FIG. 8 is a cross-sectional view illustrating a lateral bore drilling operation using a deflecting member or hollow diverter 220 in accordance with an embodiment of an alternative aspect of the present invention. As shown, the hollow diverter 220 has directed the drilling assembly 250 away from the wellbore 100 axis to form a lateral wellbore. A unique aspect of the hollow diverter 220 is that it is constructed and arranged with an aperture or fluid bypass 222. The fluid bypass 222 permits drilling fluid that is pumped from the surface of the wellbore to be communicated to the drill bit 214 during the drilling by casing operation. In other words, the installation of the hollow diverter 220 in the string of casing 216 prior to drilling the wellbore will not block fluid communication between the surface of the wellbore and the drill bit 214 during the drilling operation.

The invention claimed is:

1. A method of forming a supported bore, said method comprising the steps of:

locating a first drill bit on a steerable tool in order to provide the first drill bit with directional drilling capability;

locating the first drill bit and the steerable tool on a first expandable tubular member having an upper portion of a first diameter and a lower portion of a second, larger diameter;

drilling a bore with the drill bit mounted on the first expandable tubular member;

pumping cement into an annulus formed between the expandable tubular member and the wall of the bore;

expanding the upper portion of the tubular member to a third diameter, greater than the first diameter; and cementing the drill bit and steerable tool in place to become disposed in the supported bore.

2. A method of forming a supported bore as claimed in claim 1, wherein the first tubular member includes means for determining at least one parameter of the bore, the means for determining at least one parameter of the bore including, a data acquisition apparatus, wherein the data acquisition apparatus is retrieved, before the tubular member, drill bit and steerable tool are cemented in place within the supported bore.

3. A method of forming a supported bore as claimed in claim 2, wherein a landing joint is provided on a portion of the corresponding tubular member in order to provide a means for locating the data acquisition apparatus within the corresponding tubular member, and also for allowing the acquisition apparatus to be retrieved from within the tubular member.

4. A method of forming a supported bore as claimed in claim 3, wherein the landing joint landing joint is located above a deflecting member and is located in a fixed position relative thereto such that the orientation of the deflecting member, and thus a deflection angle, may be ascertained by the data acquisition apparatus.

5. A method of forming a supported bore as claimed in claim 2, wherein the method comprises acquiring data while the bore is being drilled, and further comprises eliminating pulling the drill bit out of the hole to perform such data acquisition in a separate operation.

6. A method of forming a supported bore as claimed in claim 4, wherein the method comprises inserting a second drill bit mounted on a second tubular member within the first tubular member; and drilling through a wall portion of the first tubular member at the location of the deflecting member and drilling a second supported bore to a second depth.

7. A method of forming a supported bore as claimed in claim 6, wherein where the second drill bit is located on a steerable tool, the steerable tool includes means for directly or indirectly determining the orientation of the second drill bit.

8. A method of forming a supported bore as claimed in claim 7, wherein where the method comprises expanding the second tubular member to support the second supported bore at an increased diameter.

* * * * *